US007024775B2

(12) United States Patent
Uchiyama

(10) Patent No.: US 7,024,775 B2
(45) Date of Patent: Apr. 11, 2006

(54) OUTER CUTTER FOR AN ELECTRIC SHAVER AND AN ELECTRIC SHAVER

(75) Inventor: Hiromi Uchiyama, Matsumoto (JP)

(73) Assignee: Izumi Products Company, Nagano (JP)

( * ) Notice: Subject to any disclaimer, the term of this patent is extended or adjusted under 35 U.S.C. 154(b) by 103 days.

(21) Appl. No.: 10/614,844

(22) Filed: Jul. 8, 2003

(65) Prior Publication Data

US 2004/0006872 A1 Jan. 15, 2004

(30) Foreign Application Priority Data

Jul. 9, 2002 (JP) ..... 2002-200381

(51) Int. Cl.
*B26B 19/04* (2006.01)

(52) U.S. Cl. ..... 30/43.92; 30/346.92

(58) Field of Classification Search ..... 30/346.51, 30/43.92, 43.91, 43.9
See application file for complete search history.

(56) References Cited

U.S. PATENT DOCUMENTS 3,386,168 A * 6/1968 Loner ..... 30/43.92
4,619,048 A 10/1986 Greutert
5,884,401 A 3/1999 Eckardt
6,317,984 B1 * 11/2001 Okabe ..... 30/43.92

FOREIGN PATENT DOCUMENTS

GB 1 289 869 9/1972
WO WO 98/48983 11/1998

* cited by examiner

*Primary Examiner*—Hwei-Siu Payer
(74) *Attorney, Agent, or Firm*—Koda & Androlia

(57) ABSTRACT

An outer cutter of a reciprocating type electric shaver in which an inner cutter makes sliding contact with an inside surface of a curved portion of the outer cutter, the curved portion being formed by bending a thin metal plate, which has numerous hair entry apertures, into a curved shape; and the curved portion being provided at both ends thereof with blocking portions that cover both ends of a space defined by the curved portion so as to prevent cut hair from being discharged to outside of the outer cutter, the blocking portions being formed integral with the curved portion.

3 Claims, 5 Drawing Sheets

OUTER CUTTER FOR AN ELECTRIC SHAVER AND AN ELECTRIC SHAVER

BACKGROUND OF THE INVENTION

1. Field of the Invention

The present invention relates to an outer cutter for an electric shaver and to an electric shaver.

2. Prior Art

Reciprocating type electric shavers cut whiskers, etc. by means of sliding contact between an inner cutter and an outer cutter. The inner cutter makes a reciprocating motion in the upper part of the main body case of the shaver by a driving mechanism contained in this main body case, and the outer cutter is attached to the supporting frame of the electric shaver so that the outer cutter covers the inner cutter. In such an electric shaver, the outer cutter makes a direct contact with the skin. Accordingly, various modifications have been made in the past in order to improve the contact of the outer cutter with the skin.

FIG. 8 shows the construction of a conventional outer cutter of a reciprocating type electric shaver.

As is shown in FIG. 8, this conventional outer cutter 100 consists of a substantially rectangular thin metal plate which has hair entry apertures (not shown) formed throughout substantially the entire surface of the plate. Furthermore, this thin metal plate is curved so that the cross section of the plate is substantially shaped in the form of an inverted U and is attached to a supporting frame which is installed on the upper end of the main body case of the electric shaver. FIG. 9 shows the conventional outer cutter 100 attached to the supporting frame.

As seen from FIG. 9, the outer cutter 100 of a conventional reciprocating type electric shaver 102 is mounted on the supporting frame 104 in such a manner that the opened areas 100*a* (see FIG. 8) formed by the curved end portions of the outer cutter 100 are closed off. In other words, when viewed from the side, the supporting frame 104 is formed so as to be larger than the opened areas 100*a* of the outer cutter. As a result, the skin is guarded by the end portions of the outer cutter 100 so that skin injury is avoided, and so that spillage of cut hair from the opened areas 100*a* of the outer cutter would not occur.

However, when the top portion 100*b* of the outer cutter of the electric shaver 102 is pressed against the skin and is moved along the skin so that hair is shaved, there may be cases in which the contact of the outer cutter with the skin is uncomfortable. More specifically, since the outer cutter is mounted on the supporting frame 104, which is formed so that the side surface shape of this frame is larger than the opened areas 100*a* of the outer cutter, the top portion 104*a* of the supporting frame (which is higher than the top portion 100*b* of the outer cutter) contacts the skin when the outer cutter 100 is moved along the skin, so that it is difficult to move the outer cutter smoothly along the skin.

Furthermore, most outer cutters of electric shavers are used with the opened areas at both ends thereof are formed by bending a foil-form thin metal plate and covered by the supporting frame. There has been no novel design along with the improvement of the outer cutter performance.

SUMMARY OF THE INVENTION

The present invention is made in light of these problems.

The object of the present invention is to provide an outer cutter for a reciprocating type electric shaver that differs from the conventional outer cutter in shape and is moved smoothly along the skin and further to a reciprocating type electric shaver that uses such an outer cutter.

The above object is accomplished by a unique structure of an outer cutter of the present invention that is used in a reciprocating type electric shaver in which an inner cutter makes sliding contact with an inside surface of a curved portion of the outer cutter, the curved portion being formed by bending a thin metal plate, which has a plurality of hair entry apertures, into a curved shape; and in the present invention, the curved portion is provided at both ends thereof with blocking portions that cover both ends of a space defined by the curved portion so as to prevent cut hair from being discharged to outside of the outer cutter, the blocking portions being formed integral with the curved portion by the thin metal plate.

In this structure, the blocking portions do not necessarily completely close off both ends of the space that is defined by the curved portion of the outer cutter; and these blocking portions can be formed with holes to the extent that holes do not allow spillage of cut hair.

Furthermore, the thickness of at least portions of the blocking portions, including boundary areas that are between the curved portion and the blocking portions, is set to be greater in thickness than the curved portion. The "boundary areas" do not refer to only linear boundaries between the curved portion and the blocking portions, but it rather refers to areas that have a specified width formed in the shape of a curved surface at the boundaries between the curved portion and the blocking portions. As a result, the outer cutter tends not to undergo easy deformation.

In addition, holes can be formed in boundary areas between the curved portion and the blocking portions.

The above object is further accomplished by a unique structure of the present invention for an electric shaver that includes:

the outer cutter described above, a supporting frame which supports the outer cutter in a detachable manner, an inner cutter which makes a reciprocating motion while making sliding contact with an inside surface of the outer cutter, and a main body case provided therein with a driving means that causes a reciprocating motion of the inner cutter and on an upper end thereof with the supporting frame.

In this structure, the top portion of the curved portion of the outer cutter is positioned higher the top portion of the supporting frame.

DETAILED DESCRIPTION OF THE INVENTION

Embodiments of the present invention will be described in detail below with reference to the accompanying drawings.

Figure 1:
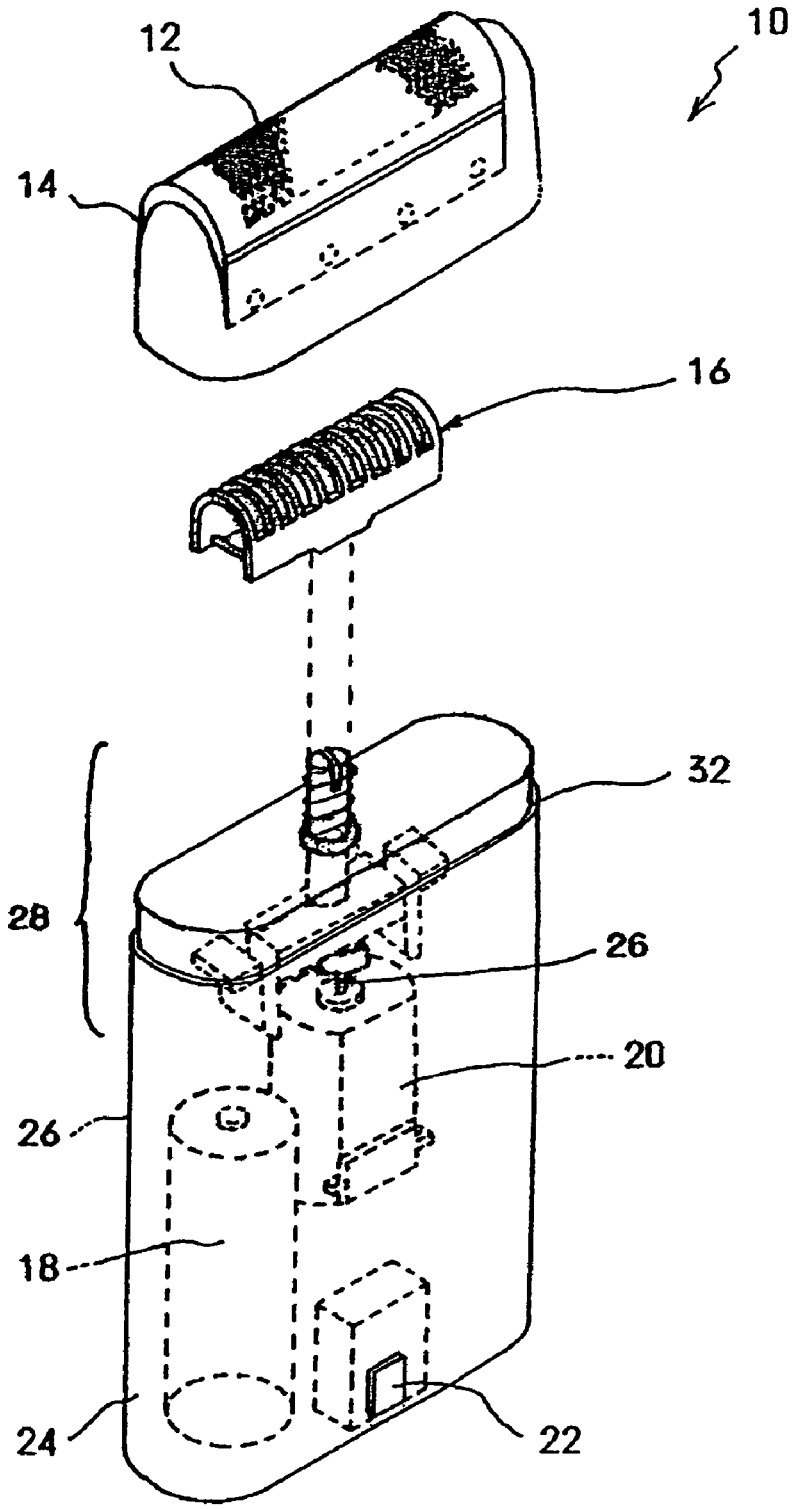
FIG. 1 is a schematic diagram that shows the construction of one embodiment of the reciprocating type electric shaver according to the present invention.

First, the overall construction of a reciprocating type electric shaver of the shown embodiment will be described with reference to FIG. 1.

The reciprocating type electric shaver 10 is comprised of an outer cutter 12 that is a thin metal plate in which a plurality of or numerous hair entry apertures are formed, a supporting frame 14 which supports this outer cutter 12 in a curved shape, and an inner cutter 16 which makes a reciprocating motion while making sliding contact with the inside surface of the outer cutter 12. The shaver 10 further includes a main body case 24 in which a battery 18, driving motor 20, etc. are installed and which has an on-off switch 22 on the front surface; and a driving mechanism 28, which is connected to the output shaft 26 of the driving motor 20 and converts the rotational motion of the driving motor 20 into a reciprocating motion and then transmits this reciprocating motion to the inner cutter 16, is provided in the main body case 24.

Figure 2:
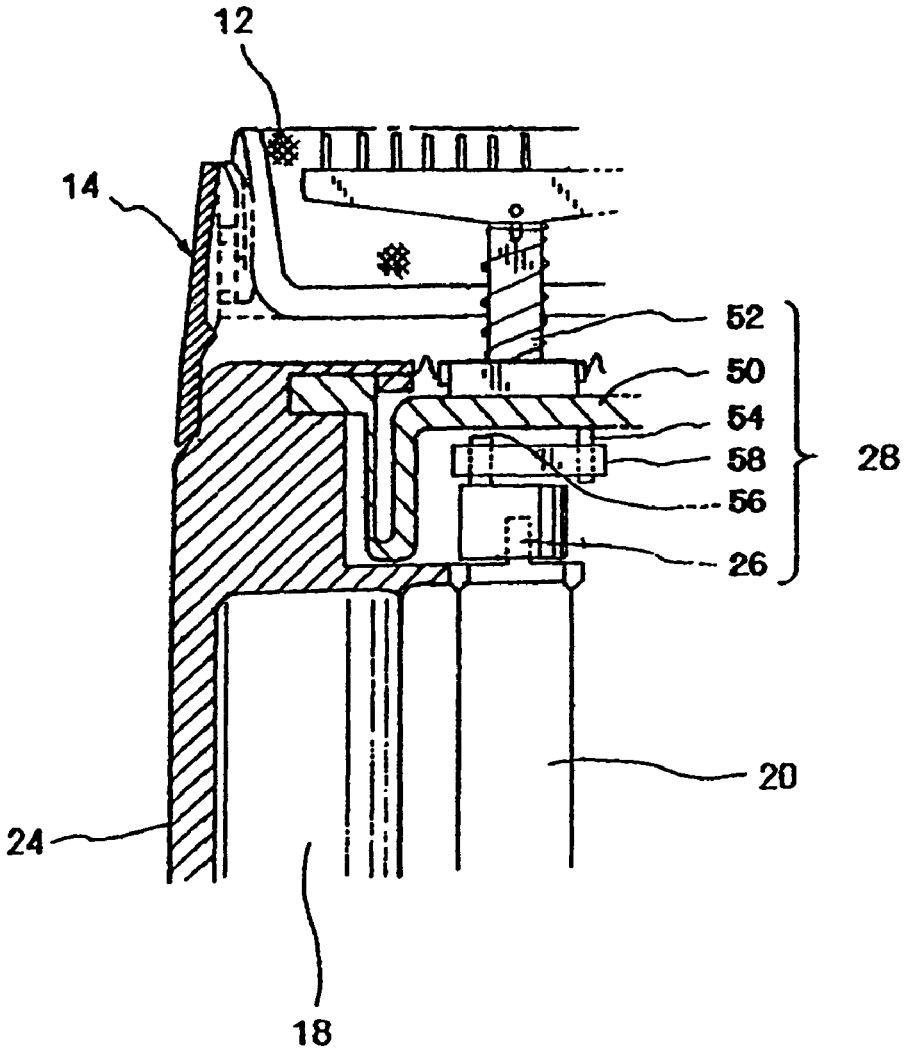
FIG. 2 is an enlarged partial view, shown in cross-section, of a part of the internal structure of the electric shaver shown in FIG. 1.

The driving mechanism 28 is shown in FIG. 2.

The driving mechanism 28 is constructed from a vibrator 50, a connecting member 52 which is disposed on the upper surface of the vibrator 50 and to which the inner cutter 16 is connected, and a link member 58 which connects a shaft 54 disposed on the undersurface of the vibrator 50 and an eccentric pin 56 attached to the output shaft 26 of the electric motor 20. This driving mechanism 28 converts the rotational motion of the output shaft 26 into a reciprocating rectilinear motion of the vibrator 50 via the link member 58. In the reciprocating type electric shaver of the present invention, the driving mechanism is not limited to the one described above, and any desired structure that has a mechanism which causes a reciprocating motion can be employed.

Next, a detailed construction of the outer cutter 12, which is the characterizing feature of the present invention, will be described with reference to FIGS. 3 and 4.

Figure 3:
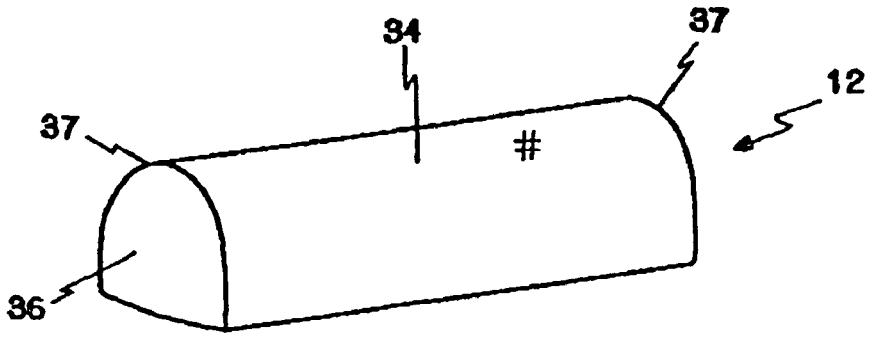
FIG. 3 is a perspective view of one embodiment of the reciprocating type outer cutter for an electric shaver of the present invention.

FIG. 3 is a perspective view that shows the one embodiment of the outer cutter of the present invention. The outer cutter 12 of the shown embodiment is constructed from a curved portion 34, in which a thin metal plate formed with numerous hair entry apertures is bent into a curved shape, and blocking portions 36, which are disposed on both ends of the space that is surrounded or defined by the curved portion 34 and which prevent cut hair from being discharged to the outside.

The curved portion 34 of the outer cutter 12 shown in FIG. 3 is obtained by forming a substantially rectangular thin metal plate made of nickel, stainless steel, etc. into an inverted U shape (in cross section). Hair entry apertures (not shown) which are formed with a size that appropriately allows the introduction of whiskers, etc. thereinto are formed throughout substantially the entire surface of the curved portion 34 of this outer cutter 12. Furthermore, cutter blades (not shown) are formed on ribs that partition the respective hair entry apertures from each other.

Blocking portions 36 that close off both ends of the space surrounded or defined by the curved portion 34 are disposed on both ends of this space. In the shown embodiment, the blocking portions 36 are formed in a substantially semicircular shape. The blocking portions 36 and the above-described curved portion 34 are formed in an integral unit by area reduction working in which a flat-plate-form thin metal plate is pushed out. The boundary areas 37, which are between the blocking portions 36 and the curved portion 34 of the outer cutter 12 formed in an integral unit, have curved surfaces.

Figure 4A:
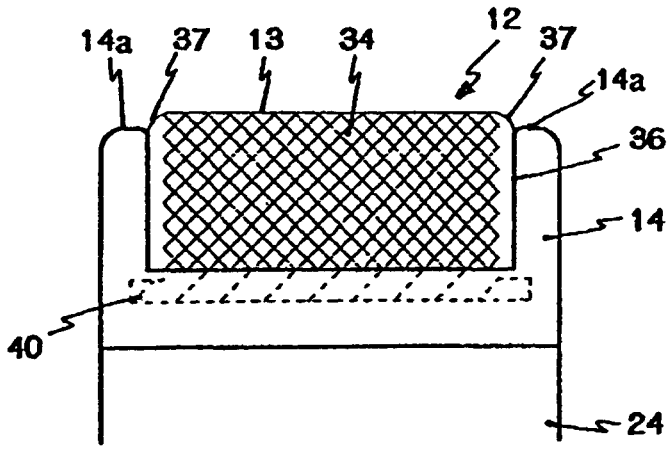
FIG. 4(*a*) shows the outer cutter of FIG. 3 attached to the supporting frame of a reciprocating type electric shaver, and FIG. 4(*b*) shows in perspective view the construction of the outer cutter in this attachment.
Figure 4B:
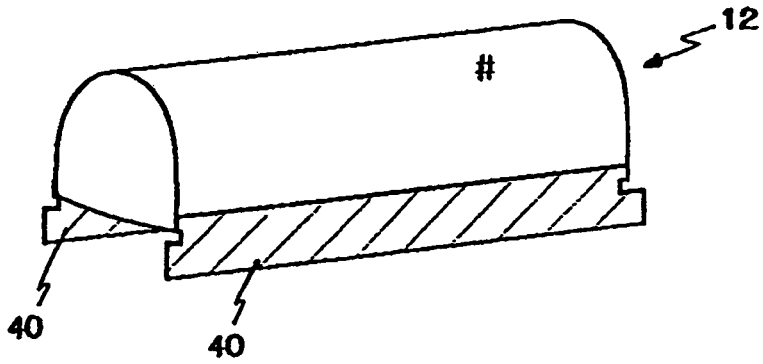

The outer cutter 12 of the above shown embodiment attached to a reciprocating type electric shaver is shown in FIGS. 4(*a*) and 4(*b*).

As shown in FIG. 4(*a*), the outer cutter 12 is mounted on the supporting frame 14 attached to the upper end of the main body case 24 so that the blocking portions 36 of the outer cutter 12 contact the inner wall surfaces of the supporting frame 14. When viewed from the side, the outer cutter 12 mounted on this supporting frame 14 is supported so that the outer surface of the outer cutter 12 is positioned further toward the outside than the circumferential end of the supporting frame 14. The attachment of the outer cutter 12 to this supporting frame 14 is accomplished by way of engaging anchoring members 40, made of a synthetic resin, etc. and disposed on the lower end portions of the curved portion 34 of the outer cutter 12, with receiving members (not shown) that are disposed on the inside of the supporting frame 14 as shown in FIG. 4(*b*).

The fact that the outer cutter 12 is thus installed so that this outer cutter 12 is positioned further to the outside than the supporting frame 14 in terms of the side shape results from the fact that the blocking portions 36 are provided on the outer cutter 12. As a result, there is no danger that cut hair will be spilled. Furthermore, since the boundary areas 37 between the curved portion 34 and the blocking portions 36 are curved or rounded, there is no danger that the skin will be caught and damaged even if the boundary areas 37 are exposed. Furthermore, as a result of this construction, the supporting frame 14 does not contact the skin even when the outer cutter 12 is moved along the skin, so that smooth movement is assured.

Furthermore, in the reciprocating type electric shaver of the present invention, the effect of the present invention is manifested if the outer cutter 12 is attached so that at least the top portion 13 of the outer cutter 12 is positioned above the top portion 14*a* of the supporting frame 14.

Figure 5:
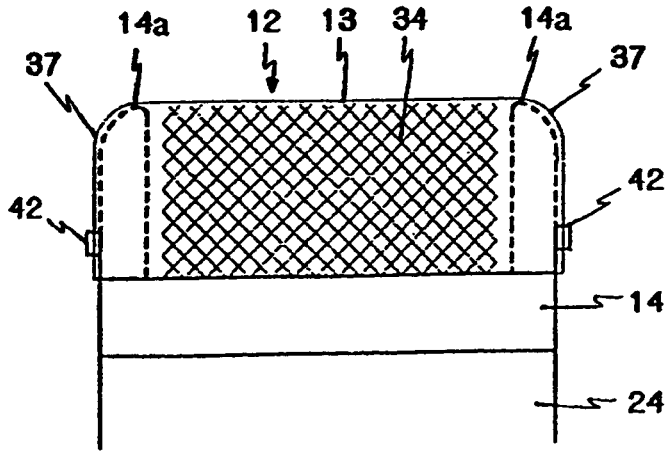
FIG. 5 shows another manner of attachment of the outer cutter of FIG. 3 to the supporting frame of a reciprocating type electric shaver.
Figure 6A:
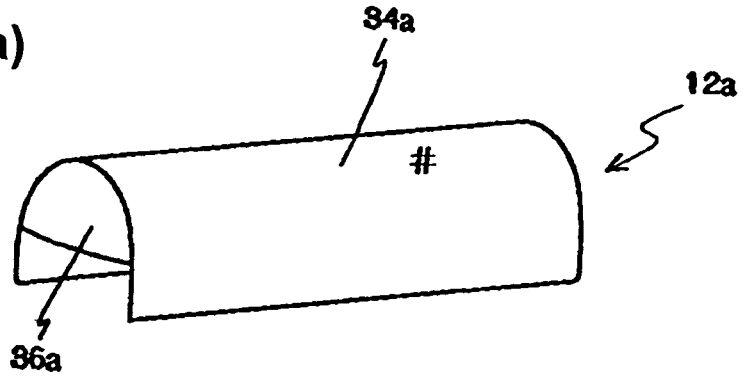
FIGS. 6(*a*) through 6(*d*) are perspective views of the constructions of the outer cutter of other embodiments of the present invention.
Figure 6B:
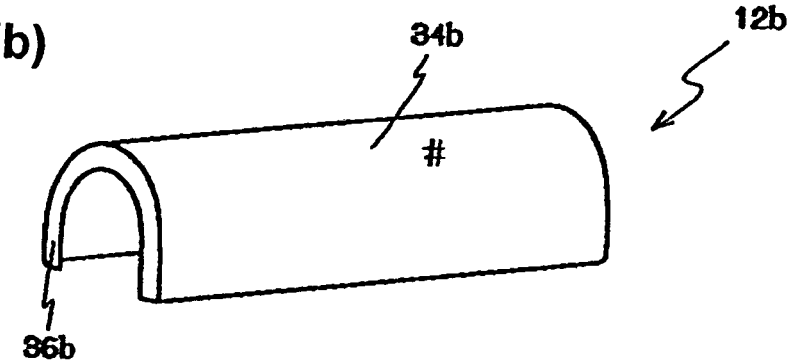
Figure 6C:
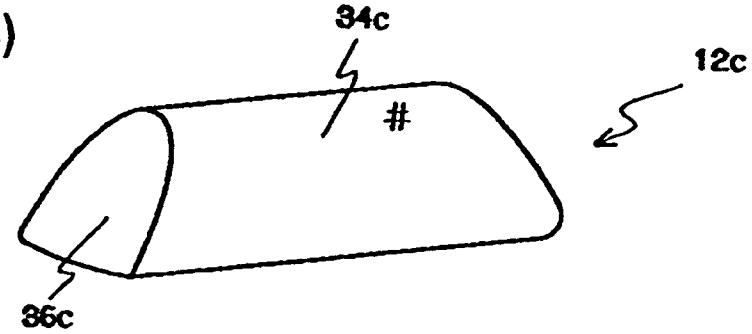
Figure 6D:
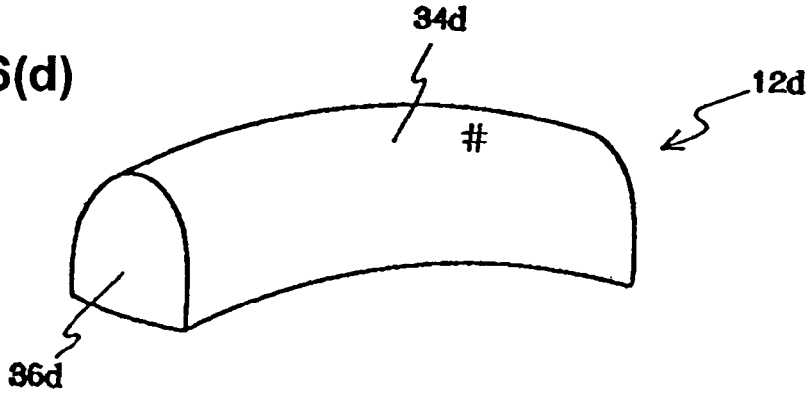

The outer cutter of the present invention is not limited to the method of disposition shown in FIG. 4(*a*). It is also possible to attach the outer cutter 12 so that the outer cutter 12 covers the supporting frame 14 as shown in FIG. 5. In other words, the blocking portions 36 of the outer cutter 12 are formed as curved surfaces that cover the outside wall surfaces of the supporting frame 14, and the outer cutter 12 is disposed so as to cover the supporting frame 14. The outer cutter 12 and the supporting frame 14 are attached by engaging projections 42 formed on the outside wall surfaces of the supporting frame 14 and holes (not shown) formed in the outer cutter 12. However, the method of attachment is not limited to this. As long as the outer cutter 12 can be appropriately attached to the supporting frame 14, any desired method may be used.

Furthermore, in the present invention, the outer cutter 12 can thus be attached so as to cover the supporting frame 14. Accordingly, an electric shaver whose design differs from that of conventional electric shavers can be provided.

Furthermore, it is desirable that the outer cutter 12 of the present invention be formed so that the thickness of at least portions of the blocking portions 36 including the boundary areas 37 with the curved portion 34 is made larger than the thickness of the curved portion 34.

For example, deformation of the outer cutter by the force that is applied when the outer cutter is caused to contact the skin can be prevent by way of making the thickness of the blocking portions 36 as a whole (including the boundary areas 37) thicker. Alternatively, it is also possible to make only the thickness of the boundary areas 37 thicker. Thus, by way of reinforcing the blocking portions 36 (including the boundary areas 37) of the outer cutter 12, deformation of the outer cutter 12 can be prevented. Such reinforcement can be made by other structures that include, for instance, reinforcing members attached to the insides of the blocking portions 36.

The outer cutter of the present invention is not limited to the shape shown in FIG. 3, and the outer cutter can be formed in any of the shapes shown in FIGS. 6(*a*) through 6(*d*).

The outer cutter 12*a* shown in FIG. 6(*a*) is provided with blocking portions 36*a* (only one blocking portion is shown) that covers the upper halves of the opened areas at both ends of the curved portion 34*a* with respect to the direction of length.

Alternatively, as seen from FIG. 6(*b*), the outer cutter 12*b* can be provided with blocking portions 36*b* that are formed in substantially an inverted U shape along the curved edges of the curved portion 34*b*.

Furthermore, in the outer cutter 12*c* shown in FIG. 6(*c*), the curved end portions of a curved portion 34*c* which is formed in a substantially inverted U-shaped cross section are cut out obliquely, and blocking portions 36*c* are disposed in the spaces formed by these cut-out end portions.

In addition, as seen from FIG. 6(*d*), the outer cutter 12*d* has the curved portion 34*d* that is curved in the direction of length and blocking portions 36*d* are disposed on both ends thereof.

With the modified outer cutters shown above, it is possible to provide an electric shaver that has a novel shape which is not limited to the shape of a conventional reciprocating type electric shaver.

Figure 7:
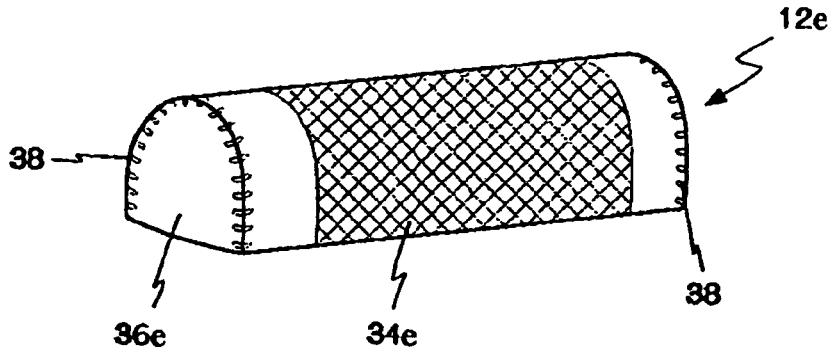
FIG. 7 is a perspective view of the construction of the outer cutter of still other embodiment of the present invention.
Figure 8:
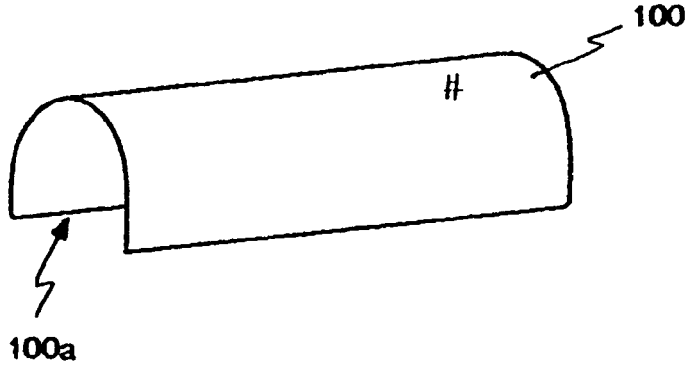
FIG. 8 PRIOR ART
FIG. 8 is a perspective view of a conventional outer cutter for a reciprocating type electric shaver.
Figure 9:
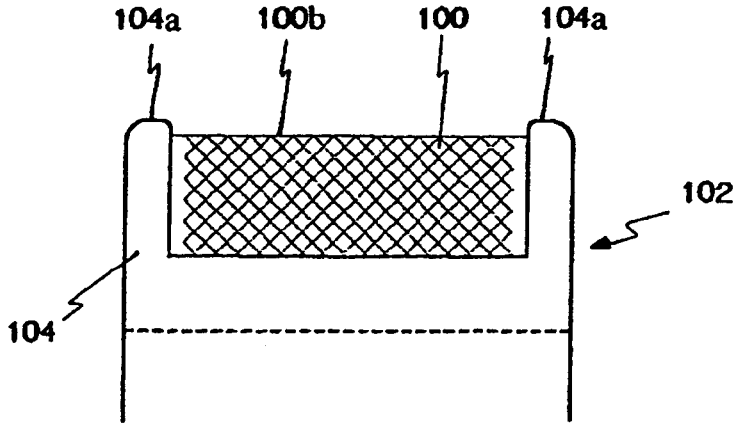
FIG. 9 PRIOR ART
FIG. 9 shows the outer cutter of FIG. 8 attached to the supporting frame of a conventional reciprocating type electric shaver.

FIG. 7 shows still another outer cutter 12*e*. In this outer cutter, a plurality of slots 38 that are oriented in the direction of connection between the curved portion 34*e* and blocking portions 36*e* are formed in the boundary areas 37*e* that are between the curved portion 34*e* and the blocking portions 36*e*. These slots 38 are in the size that does not allow the introduction of hair and are lined up in single rows along the boundary areas 37*e*. As a result, the outer cutter 12*e* can easily be bent along the boundary areas 37*e* when the outer cutter 12*e* is formed by bending work. Also, the external appearance of the outer cutter is also improved.

Furthermore, the holes formed in the boundary areas of the outer cutter are not limited to the above-described slots. Such holes can be circular holes. Moreover, there are no restrictions on the positions or number of holes, and the holes need not be disposed in rows; and a single hole can be formed.

The method of manufacturing the outer cutter of the present invention is not limited to the above-described area reduction or bending work. For example, the outer cutter can be manufactured by electro-casting in which a thick plating such as a nickel plating, etc. is formed on the surface of a matrix mold, and this thick plating is peeled from the matrix mold. A strong, thin and highly precise outer cutter can be obtained by forming the outer cutter using the electro-casting.

Furthermore, in the shown embodiment, the blocking portions 36 are formed so as to have curved surfaces; however, the blocking portions of the present invention are not limited to such blocking portions. For example, it is possible to form the blocking portions 36 to have flat surfaces or the like. In addition, the shape of the curved portion 34 is not limited to a substantially inverted U. For example, the curved portion 34 can take a substantially C-shape. Moreover, the hair entry apertures formed in the outer cutter can be of any desired shape as long as the shape meets the appropriate use.

Furthermore, the reciprocating type electric shaver of the present invention to which the outer cutter of the present invention is attached is not limited to the type described above. In other words, the electric shaver can be a so-called head pivoting electric shaver in which the outer cutter is shaft-supported on the supporting frame so as to pivot. Furthermore, the outer cutter of the present invention can be used in a two-unit electric shaver in which the outer cutters are lined up so that the top surfaces of the outer cutters are substantially parallel.

As seen from the above, according to the electric shaver of the present invention, since the blocking pats are disposed on both ends of the space surrounded or defined by the curved portion of the outer cutter, the outer cutter can be attached to the shaver main body so that the outer surface of the outer cutter is outside the circumferential end of the supporting frame in terms of the side shape. Accordingly, when the outer cutter is moved along the skin, only the outer surface of the outer cutter contacts the skin, and the electric shaver can be moved smoothly.

Furthermore, even though the outer cutter is attached so that the outer surface of the outer cutter is positioned further to the outside than the supporting frame in terms of the side shape, the discharge of cut hair to the outside of the outer cutter can be prevented by the blocking portions. Thus, the electric shaver can be used comfortably.

What is claimed is:

1. An outer cutter of a reciprocating type electric shaver in which an inner cutter makes sliding contact with an inside surface of a curved portion of said outer cutter, said curved portion being formed by bending a thin metal plate, which has a plurality of hair entry apertures, into a curved shape; wherein said curved portion is provided at both ends thereof with blocking portions that cover both ends of a space defined by said curved portion so as to prevent cut hair from being discharged to outside of said outer cutter, said blocking portions being formed integral and of a single unit with said curved portion by said thin metal plate, a thickness of at least portions of said blocking portions and of boundary areas between said curved portion and said blocking portions is greater than a thickness of said curved portion and holes are formed in said boundary areas between said curved portion and said blocking portions.

2. An electric shaver comprising:

said outer cutter according to claim 1, a supporting frame which supports said outer cutter in a detachable manner, an inner cutter which makes a reciprocating motion while making sliding contact with an inside surface of said outer cutter, and a main body case provided therein with a driving means that causes a reciprocating motion of said inner cutter and on an upper end thereof with said supporting frame.

3. The electric shaver according to claim 2, wherein a top portion of said curved portion of said outer cutter is positioned above a top portion of said supporting frame.

* * * * *